US007644776B2

(12) United States Patent
Holley et al.

(10) Patent No.: US 7,644,776 B2
(45) Date of Patent: Jan. 12, 2010

(54) FIRE FIGHTERS WATER TRANSFER PIPE

(76) Inventors: Philip A. Holley, 126 Oak St., Wakefield, RI (US) 02879; Richard Arnold, 3600 Post Rd., Wakefield, RI (US) 02879

( * ) Notice: Subject to any disclaimer, the term of this patent is extended or adjusted under 35 U.S.C. 154(b) by 359 days.

(21) Appl. No.: 11/595,224

(22) Filed: Nov. 10, 2006

(65) Prior Publication Data

US 2007/0107914 A1 May 17, 2007

Related U.S. Application Data

(60) Provisional application No. 60/735,562, filed on Nov. 10, 2005.

(51) Int. Cl.
*A62C 11/00* (2006.01)

(52) U.S. Cl. ..... 169/30; 169/54; 239/302; 239/531; 141/363; 141/382; 220/9.2; 220/23.83; 248/79

(58) Field of Classification Search ..... 169/24, 169/30, 34, 54, 70; 239/302, 303, 531; 141/363, 141/364, 382; 138/103, 109; 220/9.1, 9.2, 220/9.4, 23.83; 248/75, 79
See application file for complete search history.

(56) References Cited

U.S. PATENT DOCUMENTS

| | | | | |
|---|---|---|---|---|
| 4,139,033 | A * | 2/1979 | Brown | 141/363 |
| 4,482,017 | A * | 11/1984 | Morris | 169/24 |
| 5,797,421 | A * | 8/1998 | Merrett | 169/24 |
| 7,188,747 | B2 * | 3/2007 | Bennett et al. | 220/9.2 |
| 7,325,576 | B2 * | 2/2008 | Peterson et al. | 138/109 |

* cited by examiner

*Primary Examiner*—Steven J Ganey
(74) *Attorney, Agent, or Firm*—James Ray & Assoc.

(57) ABSTRACT

A preassembled water transfer pipe for use in a fire fighting system includes a generally hollow conduit member formed from a predetermined material and having each of a predetermined length and a predetermined cross sectional shape and a connection member equipped with a predetermined size connection for receiving a hose one of thereon and therein disposed at one end of said generally hollow conduit member. There is a pipe support assembly disposed at an opposed end of such generally hollow conduit member.

15 Claims, 5 Drawing Sheets

FIRE FIGHTERS WATER TRANSFER PIPE

CROSS REFERENCE TO RELATED APPLICATION

This patent application is related to and claims priority benefit from U.S. Provisional Patent Application Ser. No. 60/735,562 filed Nov. 10, 2005.

FIELD OF THE INVENTION

The present invention relates, in general, to fire fighting equipment and, more particularly, this invention relates to a water transfer pipe used by firefighters to transfer water from a dump tank into a drafting tank and, still more specifically, the invention finds increased importance in fighting rural fires where fire hydrants are not readily accessible.

BACKGROUND OF THE INVENTION

Prior to the conception and development of the present invention, when a fire had to be fought where hydrants are not available it was necessary for the firefighters to assemble a lot of equipment such as dump tanks, draft tans and water transfer pipes before the fire could be fought. This is a time consuming task and allows to fire to have more time to damage and/or destroy property.

As is generally well recognized in the prior art it is not practical to run water lines and to install fire hydrants in rural areas where the population is rather sparse due to the cost. Consequently, rural fires are even more prone to the above described problems.

SUMMARY OF THE INVENTION

The present invention provides, in a first aspect, a fire fighting system. The fire fighting system includes a dump tank for receiving water from a tank truck and a draft tank for receiving water from such dump tank and delivering the water to fight a fire. There is a generally hollow conduit member formed from a predetermined material provided. Such generally hollow conduit member having each of a predetermined length and a predetermined cross sectional shape and a connection member equipped with a predetermined size connection is provided to receive a hose one of thereon and therein disposed at one end of such generally hollow conduit member.

According to a second aspect, the present invention provides in combination with a fire fighting system used for dumping water in a first tank and delivering such water to be used in fighting a fire to a drafting tank, the improvement comprising a preassembled water transfer mechanism including a generally hollow conduit member formed from a predetermined material and having each of a predetermined length and a predetermined cross sectional shape and a connection member equipped with a predetermined size connection for receiving a hose one of thereon and therein disposed at one end of said generally hollow conduit member.

In a third and final aspect, the present invention provides a preassembled water transfer pipe for use in a fire fighting system which includes a generally hollow conduit member formed from a predetermined material and having each of a predetermined length and a predetermined cross sectional shape and a connection member equipped with a predetermined size connection for receiving a hose one of thereon and therein disposed at one end of said generally hollow conduit member.

OBJECTS OF THE INVENTION

It is, therefore, one of the primary objects of the present invention to provide a system, which includes a water transfer pipe, for fighting fires which will reduce the time required by the firefighters to set up the equipment required to fight the fire.

Another object of the present invention is to provide a system, which includes a water transfer pipe, for fighting fires which is relatively inexpensive to manufacture.

Still another object of the present invention is to provide a system, which includes a water transfer pipe, for fighting fires which will reduce the loss of property by reducing the set up time.

Yet another object of the present invention is to provide a system, which includes a water transfer pipe, for fighting fires which has the potential for reducing the inherent danger in fires.

An additional object of the present invention is to provide a system, which includes a water transfer pipe, for fighting fires which water transfer pipe can be supplied in a variety of sizes as necessary.

In addition to the various objects and advantages of the present invention described with some degree of specificity above it should be obvious that additional objects and advantages of the present invention will become more readily apparent to those persons who are skilled in the relevant art from the following more detailed description of the invention, particularly, when such description is taken in conjunction with the attached drawing figures and with the appended claims.

Figure 1:
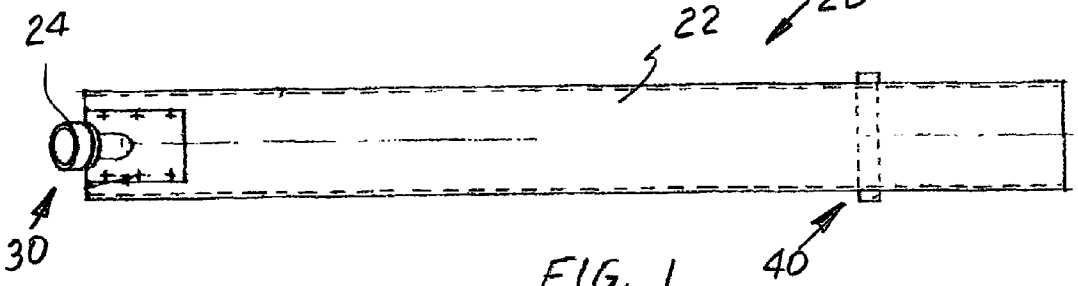
FIG. 1 is a top view of a presently preferred embodiment of a water transfer pipe according to the instant invention.
Figure 2:
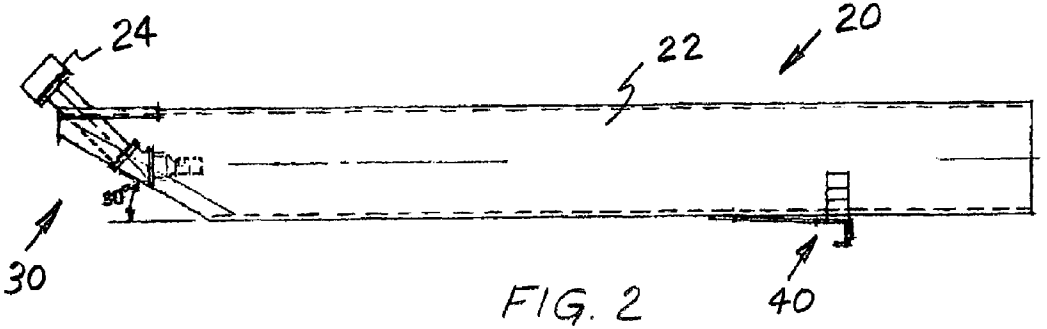
FIG. 2 is a side view of the water transfer pipe illustrated in FIG. 1.
Figure 3:
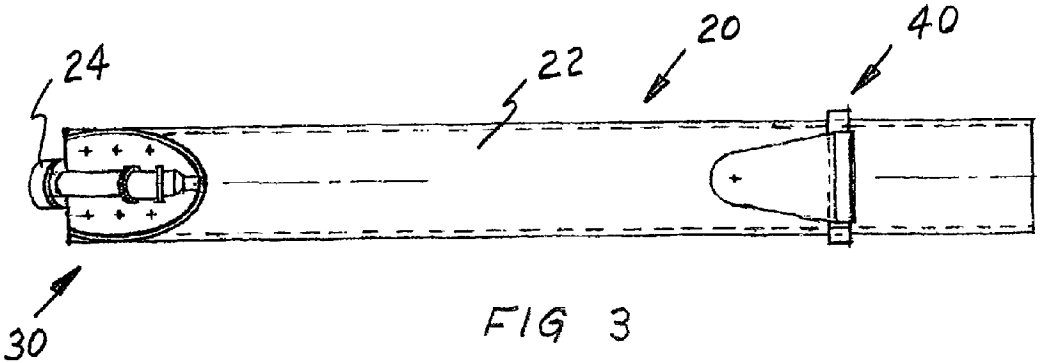
FIG. 3 is a bottom view of the water transfer pipe illustrated in FIGS. 1-2.
Figure 4:
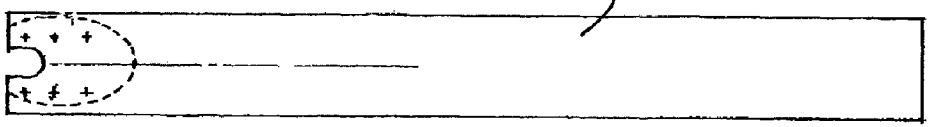
FIG. 4 is a top view of the water transfer pipe illustrated in FIGS. 1-3 without the nozzle assembly connected thereto.
Figure 5:
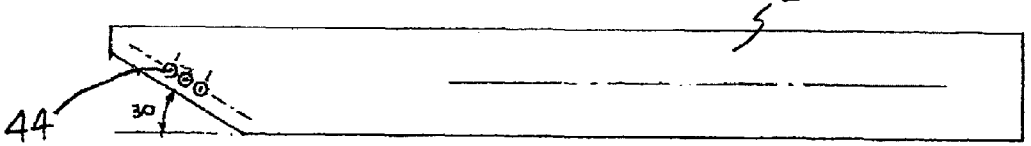
FIG. 5 is a side view of the water transfer pipe illustrated in FIGS. 1-4 without the nozzle assembly connected thereto.
Figure 6:
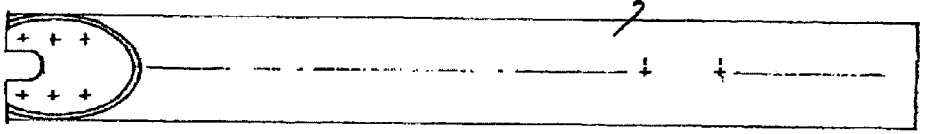
FIG. 6 is a bottom view of the water transfer pipe illustrated in FIGS. 1-5 without the nozzle assembly connected thereto.
Figure 7:
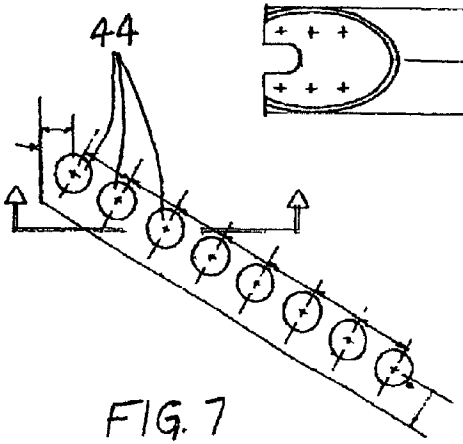
FIG. 7 is a partial view showing water intake holes disposed in the water transfer pipe illustrated in FIGS. 1-6.
Figure 8:
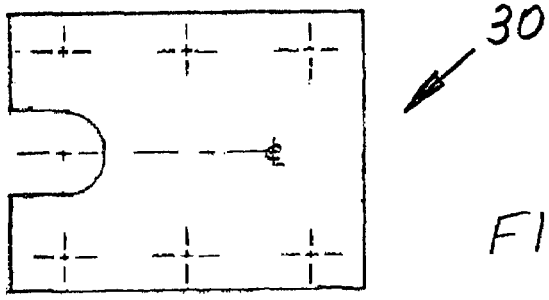
FIG. 8 is a top view of a nozzle support plate according to the present invention.
Figure 9:
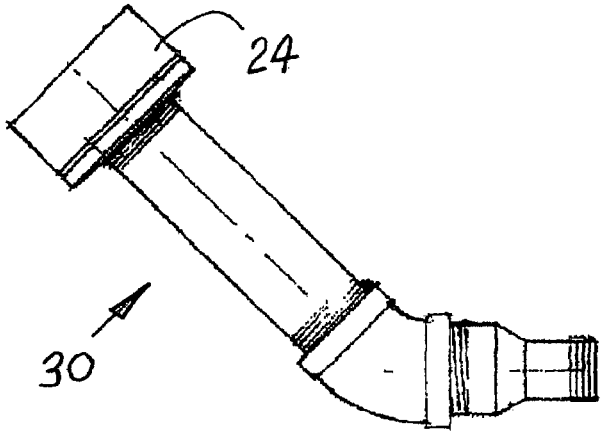
FIG. 9 is a side view of a nozzle according to the present invention.
Figure 10:
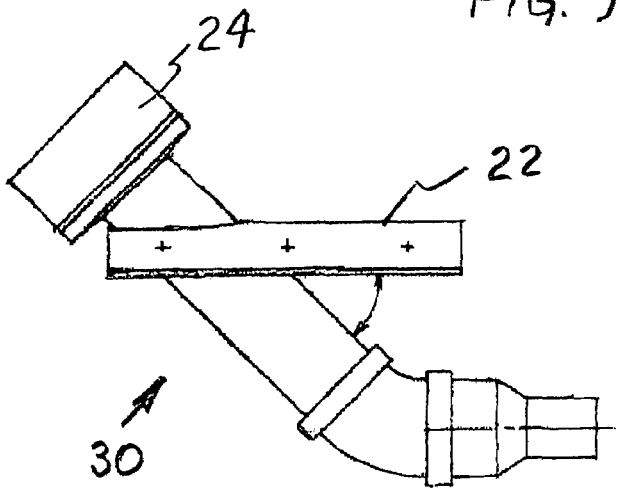
FIG. 10 is a side view of a nozzle assembly according to the present invention.
Figure 11:
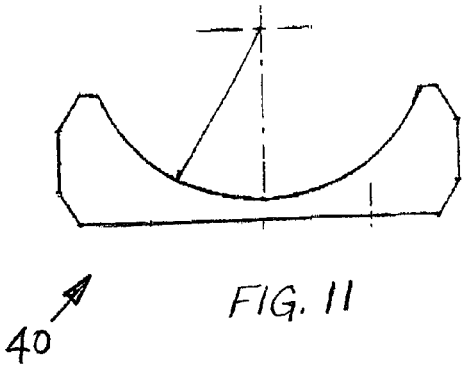
FIG. 11 is a front view of a pipe cradle used in the present invention.
Figure 12:
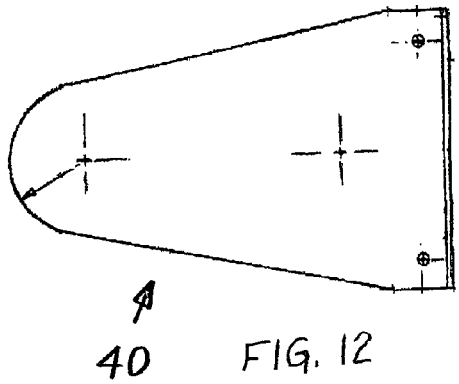
FIG. 12 is a bottom view of the pipe support plate according to the present invention.
Figure 13:
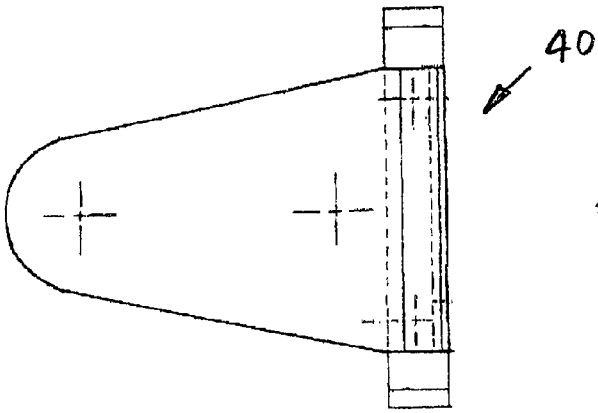
FIG. 13 is a bottom view of the pipe support assembly according to the present invention.
Figure 14:
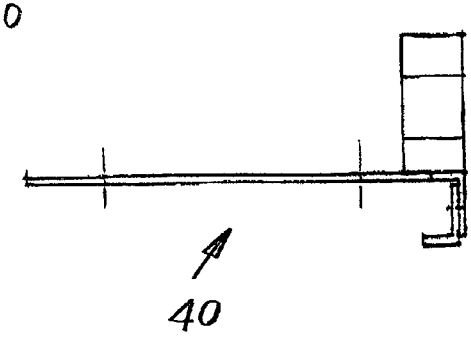
FIG. 14 is a side view of the pipe support assembly illustrated in FIGS. 12-13.

BRIEF DESCRIPTION OF A PRESENTLY PREFERRED AND VARIOUS ALTERNATIVE EMBODIMENTS OF THE INVENTION

Prior to proceeding to the more detailed description of the present invention it should be noted that, for the sake of clarity and understanding, identical components which have identical functions have been identified with identical reference numerals throughout the several views illustrated in the drawing figures.

Figure 15:
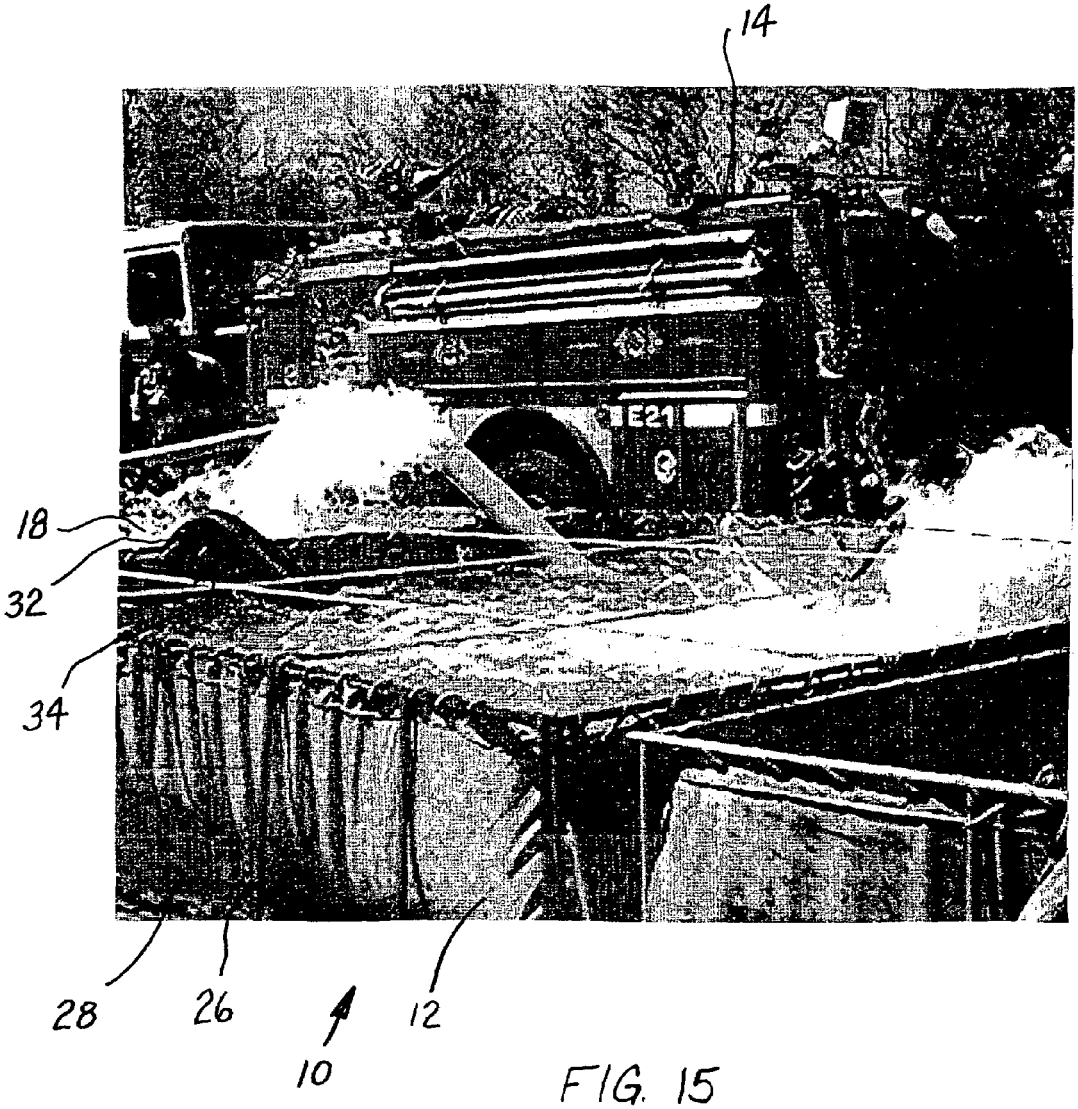
FIG. 15 is a view showing the transfer pipe illustrated in FIG. 1-14 being used to transfer water from a dump tank to a draft tank.

Now reference is made to FIG. 15 of the drawings. Illustrated therein is a presently preferred embodiment of a fire fighting system, generally designated 10. Such fire fighting system includes a dump tank 12 for receiving water from a tank truck 14. A draft tank 18 is provided for receiving water from such dump tank 12 and delivering the water to fight a fire.

In this embodiment of the invention, such dump tank 12 includes a metal framework 26 and a water impervious liner 28 disposed within such framework 26. Likewise, in this embodiment of the invention, the draft tank 18 includes a metal framework 32 and a water impervious liner 34 disposed within such framework 32.

Now reference is made to FIGS. 1-14. Illustrated therein is a water transfer apparatus, generally designated 20, which forms a part of the fire fighting system 10. The water transfer apparatus 20 includes a generally hollow conduit member 22 formed from a predetermined material and having each of a predetermined length and a predetermined cross sectional shape.

Preferably, the predetermined length of such generally hollow conduit member 22 is between about 6.0 feet to about 7.0 feet. It is most preferred that such predetermined length of the generally hollow conduit member 22 will be about 6.5 feet.

It is also most presently preferred that the predetermined cross sectional shape of such generally hollow conduit member 22 will be generally cylindrical. Additionally, such predetermined material the generally hollow conduit member 22 is formed from is plastic and such plastic is preferably PVC.

Water transfer apparatus 20 also includes a connection means, generally designated 30, equipped with a predetermined size connection 24 for receiving a hose (not shown) one of thereon and therein disposed at one end of such generally hollow conduit member 22. As shown in amended FIG. 5 and FIG. 7, multiple water-intake holes or apertures 44 are provided in the walls of the hollow conduit member 20 proximal the connection means 30. In the presently preferred embodiments of the invention the predetermined size connection 24 for receiving a hose is one of a 1.5 inch and a 2.5 inch connection.

Alternatively, the predetermined cross sectional shape of such generally hollow conduit member 22 can be selected from the group consisting of rectangular, hexagonal and octagonal and such fire fighting system will further include a means (not shown) connected thereto for accepting such connection member 24. Regardless of the cross sectional shape, a support means assembly 40 is secured to the outer surface of the conduit member 22 adjacent the end of the conduit member 22 opposite the connection member 24. This holds the discharge end of the conduit member 22 adjacent the framework 32 of the dump tank 12.

In another embodiment the present invention provides in combination with a fire fighting system 10 used for dumping water into a dump tank 12 and delivering water to be used in fighting a fire from a drafting tank 13 wherein the improvement comprising a preassembled water transfer mechanism 20. Such water transfer mechanism 20 includes a generally hollow conduit member 22 formed from a predetermined material and having each of a predetermined length and a predetermined cross sectional shape and a connection member 30 equipped with a predetermined size connection 24 for receiving a hose one of thereon and therein disposed at one end of said generally hollow conduit member 22.

In a final aspect the present invention provides a preassembled water transfer pipe 20 for use in a fire fighting system 10. Such water transfer pipe 20 includes a generally hollow conduit member 22 formed from a predetermined material and having each of a predetermined length and a predetermined cross sectional shape and a connection member 30 equipped with a predetermined size connection 24 for receiving a hose one of thereon and therein disposed at one end of said generally hollow conduit member 22. Additionally, there is a conduit member 22 support means, generally designated 40, disposed at one end of such conduit member 22.

While a presently preferred and various alternative embodiments of the present invention have been described in sufficient detail above to enable a person skilled in the relevant art to make and use the same it should be obvious that various other adaptations and modifications can be envisioned by those persons skilled in such art without departing from either the spirit of the invention or the scope of the appended claims.

We claim:

1. A fire fighting system, said fire fighting system comprising:

(a) a dump tank for receiving water from a tank truck;

(b) a draft tank for receiving water from said dump tank and delivering water to fight a fire;

(c) a generally hollow conduit member formed from a predetermined material and having each of a predetermined length and a predetermined cross sectional shape;

(d) a connection member equipped with a predetermined size connection for receiving a hose one of thereon and therein disposed at one end of said generally hollow conduit member;

(e) a support means disposed on an exterior surface of said generally hollow conduit member adjacent an end opposite said one end for engaging with a said dump tank; and (f) at least two apertures disposed in said generally hollow conduit member providing a water intake for the generally hollow conduit member proximal said connection member.

2. A fire fighting system, according to claim 1, wherein said dump tank includes a metal framework and a water impervious liner disposed within said framework.

3. A fire fighting system, according to claim 2, wherein said drafting tank includes a metal framework and a water impervious liner disposed within said framework.

4. A fire fighting system, according to claim 1, wherein said predetermined length of said generally hollow conduit member is between about 6.0 feet to about 7.0 feet.

5. A fire fighting system, according to claim 4, wherein said predetermined length of said generally hollow conduit member is about 6.5 feet.

6. A fire fighting system, according to claim 1, wherein said predetermined cross sectional shape of said generally hollow conduit member is generally cylindrical.

7. A fire fighting system, according to claim 1, wherein said predetermined material said generally hollow conduit member is formed from is plastic.

8. A fire fighting system, according to claim 7, wherein said plastic is PVC.

9. A fire fighting system, according to claim 1, wherein said predetermined size connection for receiving a hose is one of a 1.5 inch and a 2.5 inch connection.

10. In combination with a fire fighting system used for dumping water in a dump tank and delivering water to be used in fighting a fire from a drafting tank the improvement comprising a preassembled water transfer apparatus including:

(a) a generally hollow conduit member formed from a predetermined material and having each of a predetermined length and a predetermined cross sectional shape;

(b) a connection member equipped with a predetermined size connection for receiving a hose one of thereon and therein disposed at one end of said generally hollow conduit member;

(c) a support means disposed on an exterior surface of said generally hollow conduit member adjacent an end opposite said one end for engaging with said dump tank; and d) at least two apertures disposed in said generally hollow conduit member providing a water intake for the generally hollow conduit member proximal said connection member.

11. A water transfer pipe, according to claim 10, wherein said predetermined size connection for receiving a hose is one of a 1.5 inch and a 2.5 inch connection.

12. A water transfer pipe, according to claim 10, wherein said predetermined material said generally hollow conduit member is formed from is plastic.

13. A preassembled water transfer pipe for use in a fire fighting system, said water transfer pipe comprising:

(a) a generally hollow conduit member formed from a predetermined material and having each of a predetermined length and a predetermined cross sectional shape; and (b) a connection member equipped with a predetermined size connection for receiving a hose one of thereon and therein disposed at one end of said generally hollow conduit member;

(c) a support means disposed on an exterior surface of said generally hollow conduit member adjacent an end opposite said one end for engaging with a dump tank; and d) at least two apertures disposed in said generally hollow conduit member providing a water intake for the generally hollow conduit member proximal said connection member.

14. A water transfer pipe, according to claim 13, wherein said predetermined size connection for receiving a hose is one of a 1.5 inch and a 2.5 inch connection.

15. A water transfer pipe, according to claim 13, wherein said predetermined material said generally hollow conduit member is formed from is plastic.

* * * * *